US008075221B2

(12) United States Patent
MacKenzie

(10) Patent No.: US 8,075,221 B2
(45) Date of Patent: Dec. 13, 2011

(54) PAVER ASSEMBLY

(75) Inventor: David S. MacKenzie, Nunica, MI (US)

(73) Assignee: Hortech, Inc., Spring Lake, MI (US)

( * ) Notice: Subject to any disclaimer, the term of this patent is extended or adjusted under 35 U.S.C. 154(b) by 110 days.

(21) Appl. No.: 12/616,802

(22) Filed: Nov. 12, 2009

(65) Prior Publication Data

US 2011/0110718 A1 May 12, 2011

(51) Int. Cl.
*E01C 5/22* (2006.01)
*B29C 39/00* (2006.01)

(52) U.S. Cl. ..... 404/36; 404/44; 264/299

(58) Field of Classification Search ..... 404/34–41, 404/43, 44; 264/299
See application file for complete search history.

(56) References Cited

U.S. PATENT DOCUMENTS

| | | | | | |
|---|---|---|---|---|---|
| 368,398 | A | * | 8/1887 | Hoyt | 404/17 |
| 1,070,375 | A | | 8/1913 | Reyam et al. | |
| 1,637,567 | A | | 8/1927 | Herrick | |
| 1,968,189 | A | * | 7/1934 | Bartels | 249/18 |
| 3,299,601 | A | | 1/1967 | Chiville | |
| 3,605,366 | A | | 9/1971 | Zakim | |
| 3,694,128 | A | * | 9/1972 | Foxen | 425/412 |
| 3,775,918 | A | * | 12/1973 | Johnson | 52/155 |
| 3,827,818 | A | | 8/1974 | Ruyters | |
| 3,940,229 | A | * | 2/1976 | Hutton | 425/436 R |
| 3,950,908 | A | | 4/1976 | Van Eyk | |
| 4,226,064 | A | * | 10/1980 | Kraayenhof | 52/180 |
| 4,453,359 | A | | 6/1984 | Robinson | |
| 4,545,754 | A | * | 10/1985 | Scheidt et al. | 425/419 |
| 4,627,764 | A | * | 12/1986 | Scheiwiller | 404/41 |
| 4,628,645 | A | * | 12/1986 | Tafelski, Jr. | 52/169.1 |
| 4,655,018 | A | | 4/1987 | Pardo | |
| 4,674,245 | A | | 6/1987 | Turner | |
| 4,963,054 | A | * | 10/1990 | Hayashi | 404/34 |
| 5,062,610 | A | * | 11/1991 | Woolford et al. | 249/52 |
| 5,111,627 | A | | 5/1992 | Brown | |
| 5,281,048 | A | * | 1/1994 | Hagenah | 404/44 |
| 5,281,459 | A | | 1/1994 | Van Eijck | |
| 6,460,301 | B1 | | 10/2002 | McKee | |
| 6,627,315 | B2 | * | 9/2003 | Sakai | 428/406 |
| 6,655,103 | B1 | | 12/2003 | Lueghamer | |
| 6,711,851 | B2 | | 3/2004 | Mischo | |
| 6,776,556 | B2 | * | 8/2004 | Hessner | 404/44 |
| 6,862,842 | B2 | | 3/2005 | Mischo | |
| 6,911,248 | B2 | | 6/2005 | Sabatini | |
| 7,100,886 | B2 | * | 9/2006 | Hammer et al. | 249/104 |
| 7,204,470 | B2 | * | 4/2007 | Jurik | 249/74 |
| 7,344,334 | B2 | | 3/2008 | Thorkelson | |
| 7,819,607 | B2 | * | 10/2010 | Carreras-Maldonado et al. | 404/34 |
| 2002/0007591 | A1 | | 1/2002 | Mischo | |
| 2005/0102921 | A1 | | 5/2005 | Mischo | |

FOREIGN PATENT DOCUMENTS

| | | | | |
|---|---|---|---|---|
| EP | 1306485 | | | 2/2003 |
| GB | 2172638 | A | * | 3/1985 |
| JP | 404347222 | A | * | 12/1992 |

* cited by examiner

*Primary Examiner* — Raymond Addie
(74) *Attorney, Agent, or Firm* — Price Heneveld LLP

(57) ABSTRACT

A paver assembly includes a substrate member having a bottom wall adapted to support the paver assembly above a roof surface, a plurality of sidewalls extending upwardly from the bottom wall, and at least one engagement member extending above the bottom wall, and an over-molded paver member having a bottom surface, a plurality of side surfaces, and a top surface adapted to support a person thereon, wherein the bottom surface is molded about the at least one engagement member, thereby securing the paver member to the substrate member.

14 Claims, 6 Drawing Sheets

PAVER ASSEMBLY

BACKGROUND OF THE INVENTION

The present invention relates to a paver, and in particular to a paver assembly for use in conjunction with roof vegetation systems.

SUMMARY OF THE INVENTION

One aspect of the present invention is to provide a paver assembly that comprises a substrate member having a bottom wall adapted to support the paver assembly above a roof surface, a plurality of sidewalls extending upwardly from the bottom wall, and at least one engagement member extending above the bottom wall, and an over-molded paver member having a bottom surface, a plurality of side surfaces, a top surface adapted to support a person thereon, wherein the bottom surface is molded about the at least one engagement member, thereby securing the paver member to the substrate member.

Another aspect of the present invention is to provide a paver assembly that comprises a substrate member having a bottom wall adapted to support the paver assembly above a roof surface, a plurality of sidewalls extending upwardly from the bottom wall, and at least one engagement member extending above the bottom wall, and a paver member coupled to the substrate member and having a bottom surface, a plurality of side surfaces, and a top surface adapted to support a person thereon. The paver assembly further comprises at least one shim member that includes a first portion of an engagement member, wherein the bottom wall of the substrate member includes a second portion of an engagement member that engages the first portion of the engagement member, thereby aligning the at least one shim member with the substrate member.

Yet another aspect of the present invention is to provide a method of forming a paver assembly that comprises providing a mold, and forming a paver member by placing a curable material into the mold, the paver member including a bottom surface, a plurality of side surfaces, and a top surface adapted to support a person thereon. The method further comprises providing a substrate member having a bottom wall adapted to support the paver assembly upon the roof surface, a plurality of side surfaces extending upwardly from the bottom wall, and at least one engagement member extending above the bottom wall, and pressing the at least one engagement member into the bottom surface of the paver member. The method further comprises curing the curable material, and removing the paver assembly from the mold.

The principal objects of the present invention are to provide a durable paving assembly adapted for use with modular vegetated roof systems, that include an uncomplicated design which may be assembled without tools by even unskilled personnel. The present inventive paver assembly is efficient in use, economical to manufacture, capable of a long-operating life, and is particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
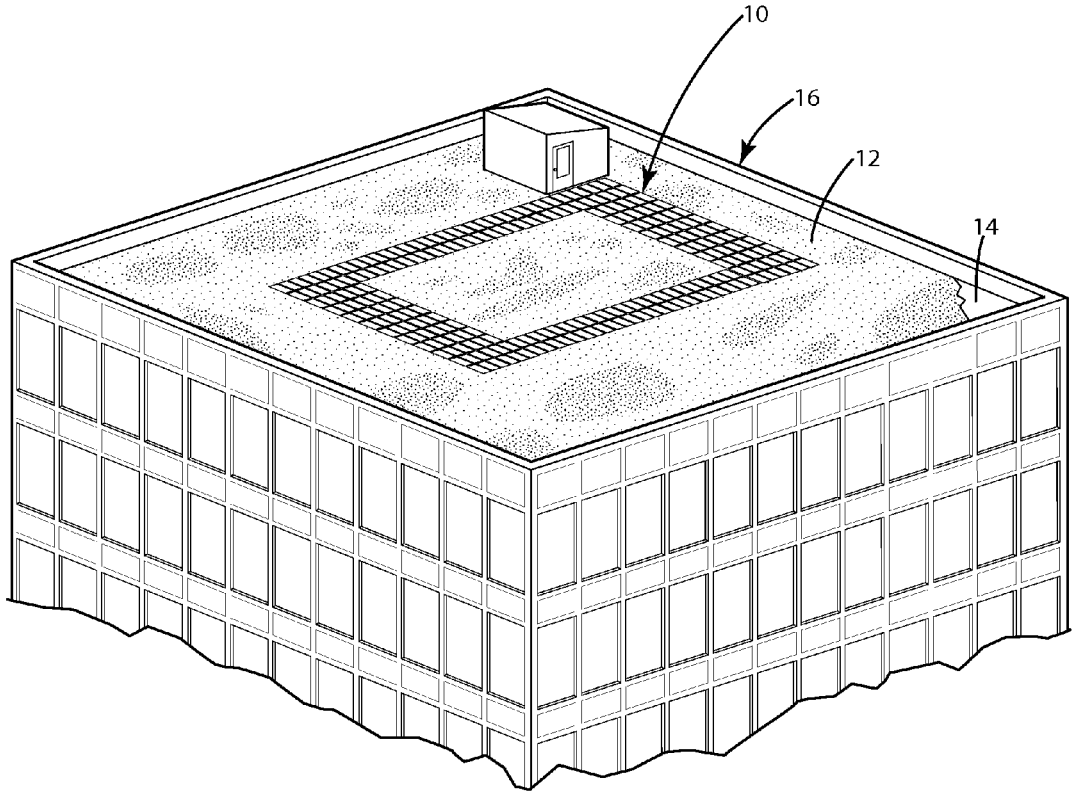
FIG. 1 is a perspective view of a building structure supporting a plurality of paver assemblies thereon, wherein the paver assemblies embody the present invention.
Figure 2:
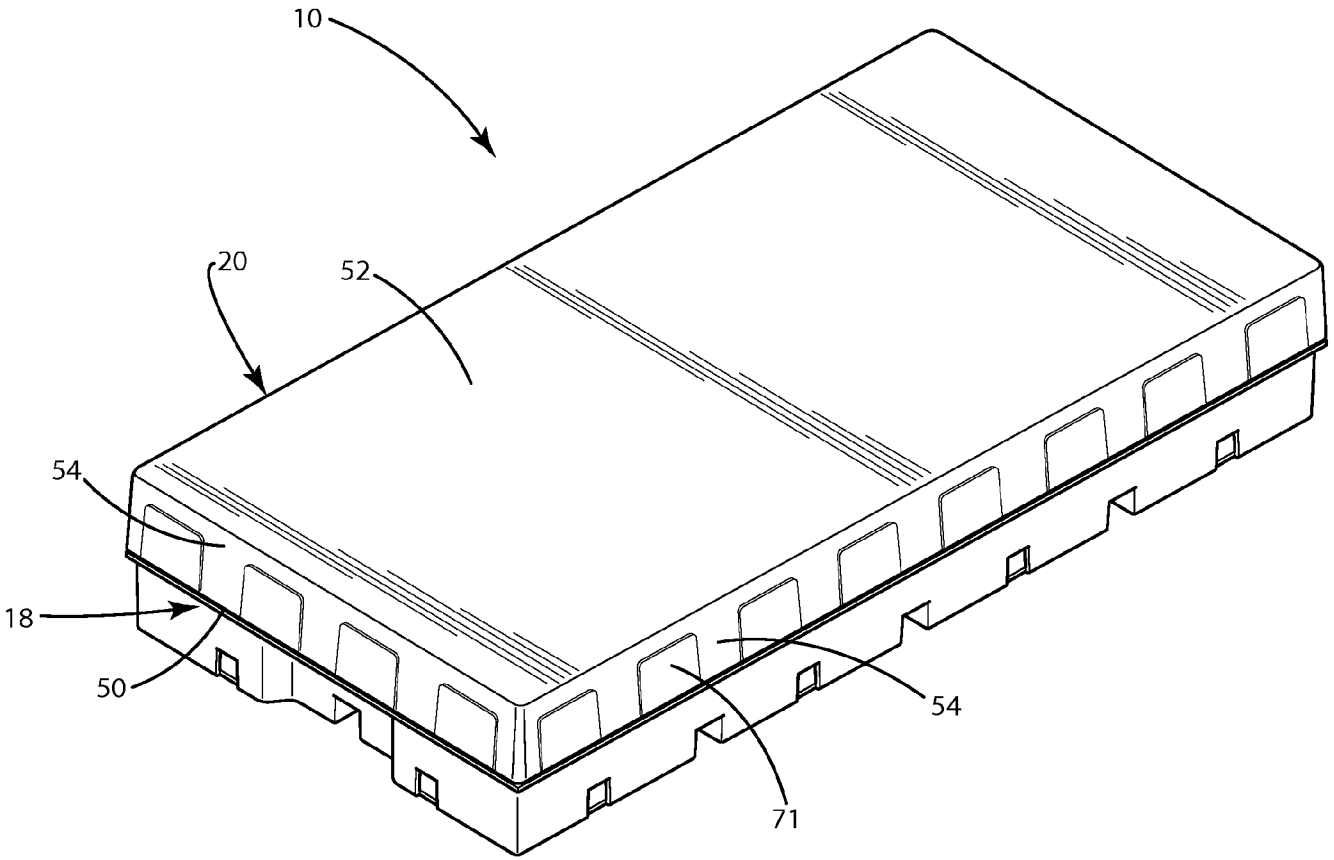
FIG. 2 is a perspective view of an individual paver assembly.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a paver assembly embodying the present invention. In the illustrated example, a plurality of the paver assemblies 10 are used in conjunction with a plurality of modular planting assemblies 12 utilized to provide a vegetated roof system upon a roof structure 14 of a corresponding building structure 16. The planter assemblies are disclosed in detail in U.S. patent application Ser. No. 11/623,168, entitled MODULAR PLANTING SYSTEMS FOR ROOF APPLICATIONS, as filed Jan. 15, 2007, which is incorporated herein by reference in its entirety. The plurality of paver assemblies 10 cooperate to provide a support structure upon which persons can move about the vegetated roof system in order to maintain the same, enjoy the park-like setting as created by the system, and the like.

Figure 3:
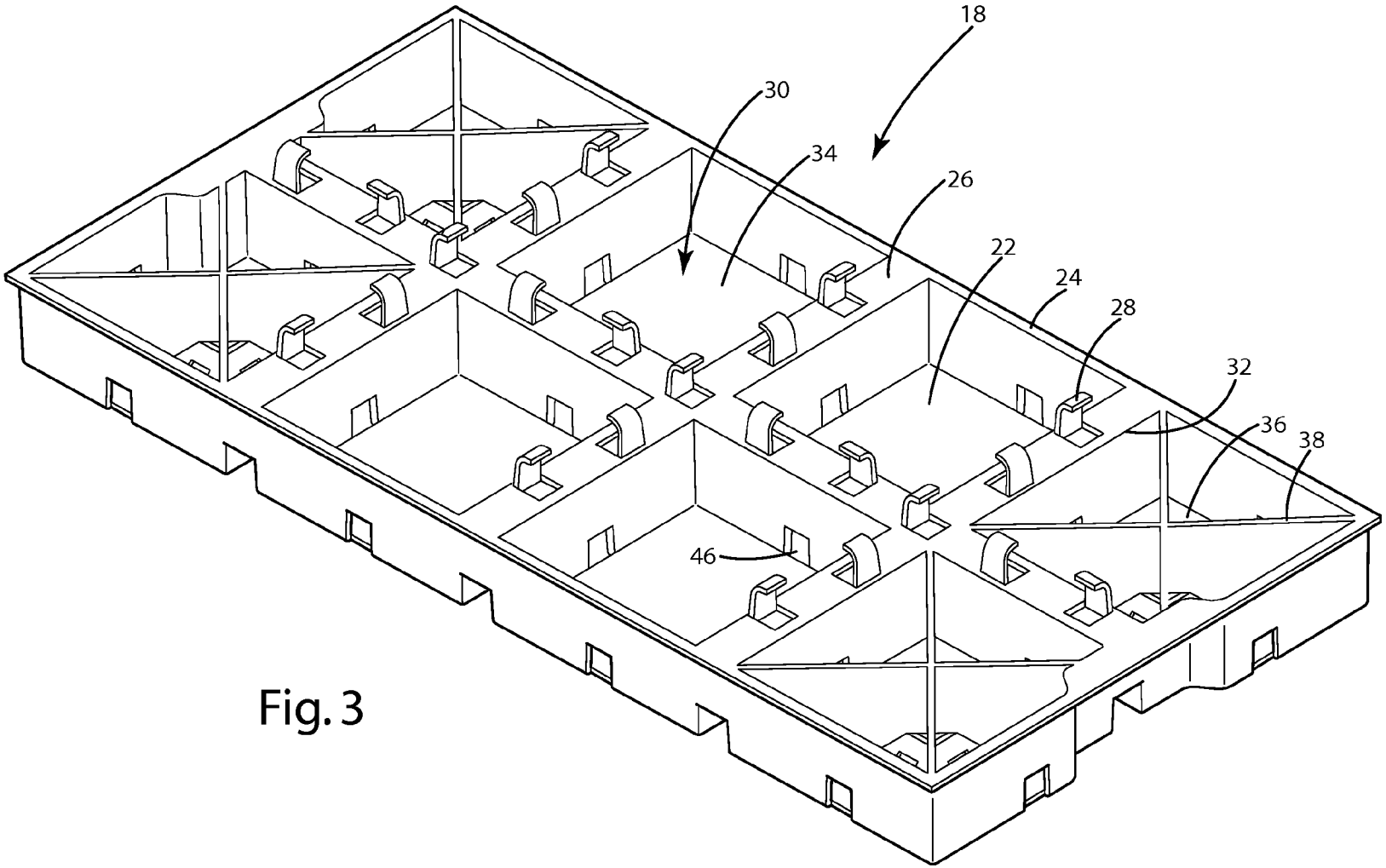
FIG. 3 is a perspective view of a substrate member of the paver assembly.
Figure 4:
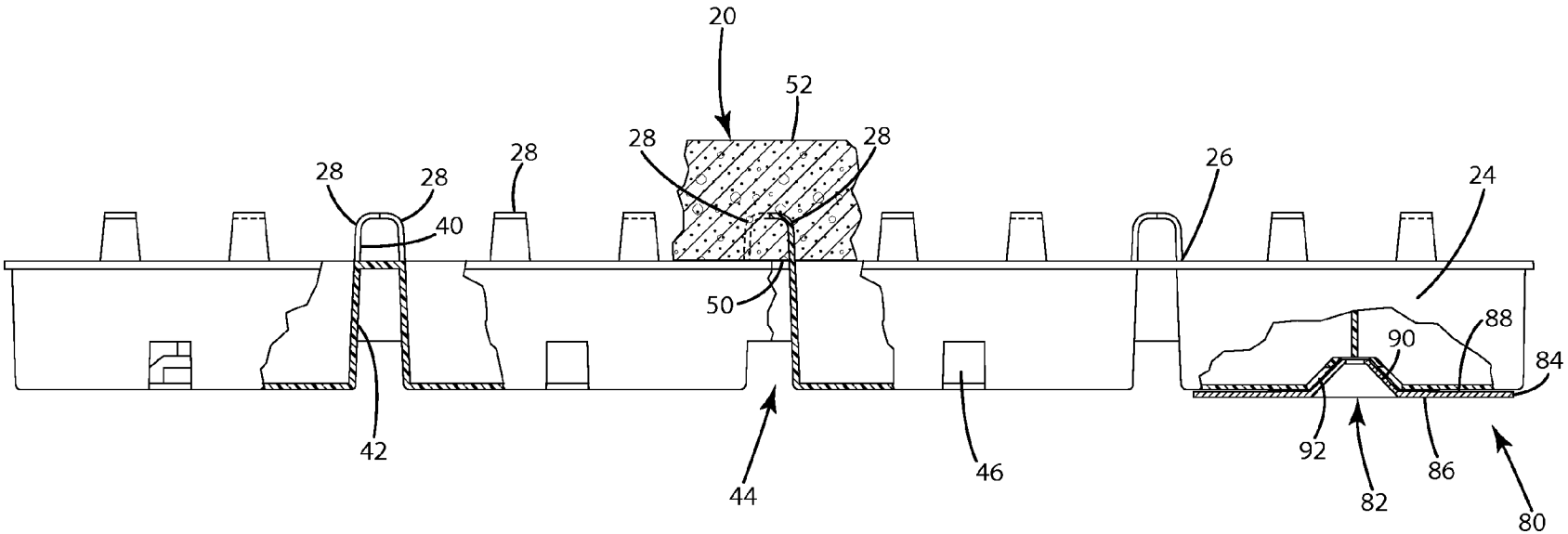
FIG. 4 is a partially cross-sectional side view of the substrate member.
Figure 5:
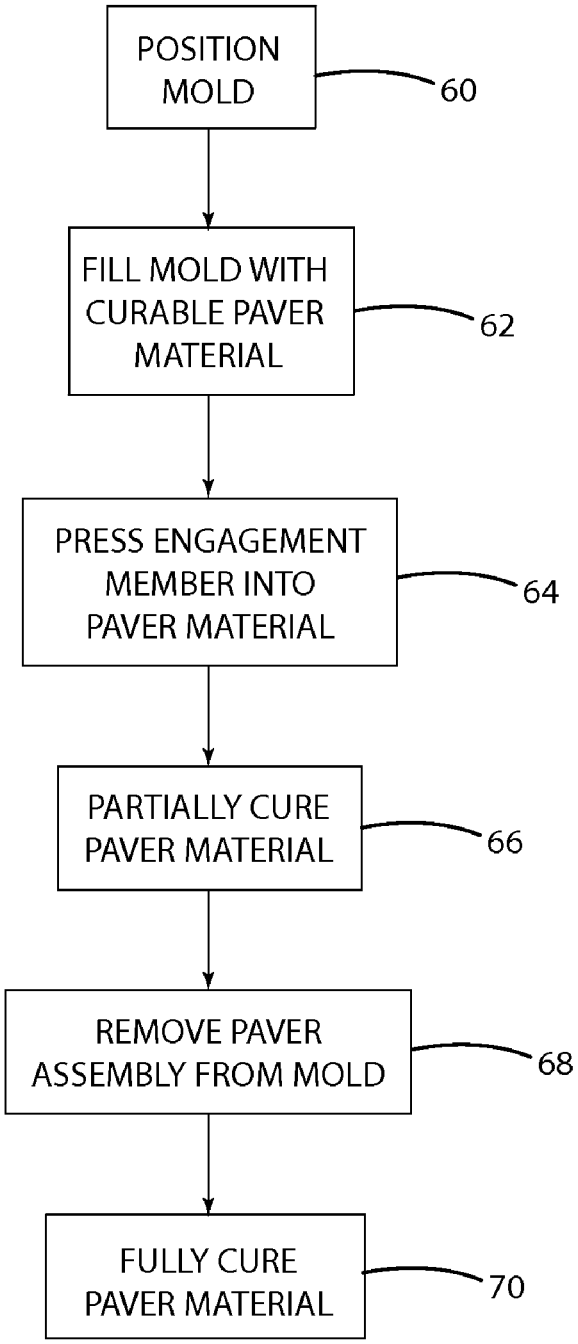
FIG. 5 is a flow chart of a method for constructing the paver assembly.

As best illustrated in FIG. 2, each paver assembly 10 comprises a substrate member 18 and an over-molded paver member 20. The substrate member 18 is preferably constructed of a recycled polypropylene material, however, other materials compatible for such use may be utilized. The substrate member 18 (FIG. 3) includes a box-like structure having a bottom wall 22 adapted to support the paver assembly 10 above the roof surface 14, a plurality of sidewalls 24 extending upwardly from the bottom wall 22, a top wall 26, and a plurality of engagement members 28 extending upwardly from the top wall 26. The bottom wall 22 and the sidewalls 24 cooperate to form an interior space 30 that is subdivided into multiple compartments via a plurality of intermediate walls 32 extending between pairings of sidewalls 24. In the illustrated example, the interior space 30 is divided into eight compartments including central compartments 34 and end compartments 36. Each end compartment 36 is subdivided by crosswise-extending structural reinforcement walls 38 that serve to structurally reinforce the outwardly lying end portions of the substrate member 18 and overall paver assembly 10, as described below. As best illustrated in FIG. 4, each engagement member 28 is hook-shaped, and includes an outer surface 40 that is aligned with an outer surface 42 of a corresponding intermediate wall 32, thereby serving to structurally reinforce the engagement member 28 as the engagement member 28 is positioned directly above and extends upwardly from the intermediate wall 32.

A plurality of water passages 44 extend beneath the substrate member 18 and are formed by cooperating pairs of intermediate walls 32, thereby allowing water to pass beneath the paver assembly 10. In addition, a plurality of apertures 46 extend through the intermediate walls 32 and the sidewalls 24, thereby providing fluid communication between the interior space 30 of the substrate member 18 and allowing water to pass from the interior space 30 to the water passages 44 and/or the exterior of the substrate member 18.

The paver member 20 includes a bottom surface 50, a top surface 52, and a plurality of side surfaces 54 extending therebetween. The top surface 52 is adapted to support a person thereon. The paver member 20 is preferably constructed from a light-weight concrete, or other suitable material that may be formed about the engagement members 28 of the substrate member 18, as described below.

In assembly, a latex mold is positioned (60) and receives a curable paver material therein (62), subsequent to which the material is smoothed and vibrated within the mold so as to remove any trapped air. The substrate member 18 is then inverted and the engagement members 28 pressed into engagement within the bottom surface of the yet to be cured paver material (64), such that the engagement members 28 are completely encased within the paver material. The paver material is then partially cured (66) and then removed from the mold (68). The paver assembly 10 is then fully cured (70) subsequent to being removed from within the mold.

As best illustrated in FIG. 2, the paver member 20 is formed to include a plurality of irregularities in the form of rectangularly-shaped tabs 71 extending outwardly from the side surfaces 54. In use, the tabs 71 abut the tabs 71 of adjacently-positioned paver assemblies 10, and cooperate to form gaps or spaces between abutting paver assemblies, thereby allowing water to flow therebetween.

Figure 6:
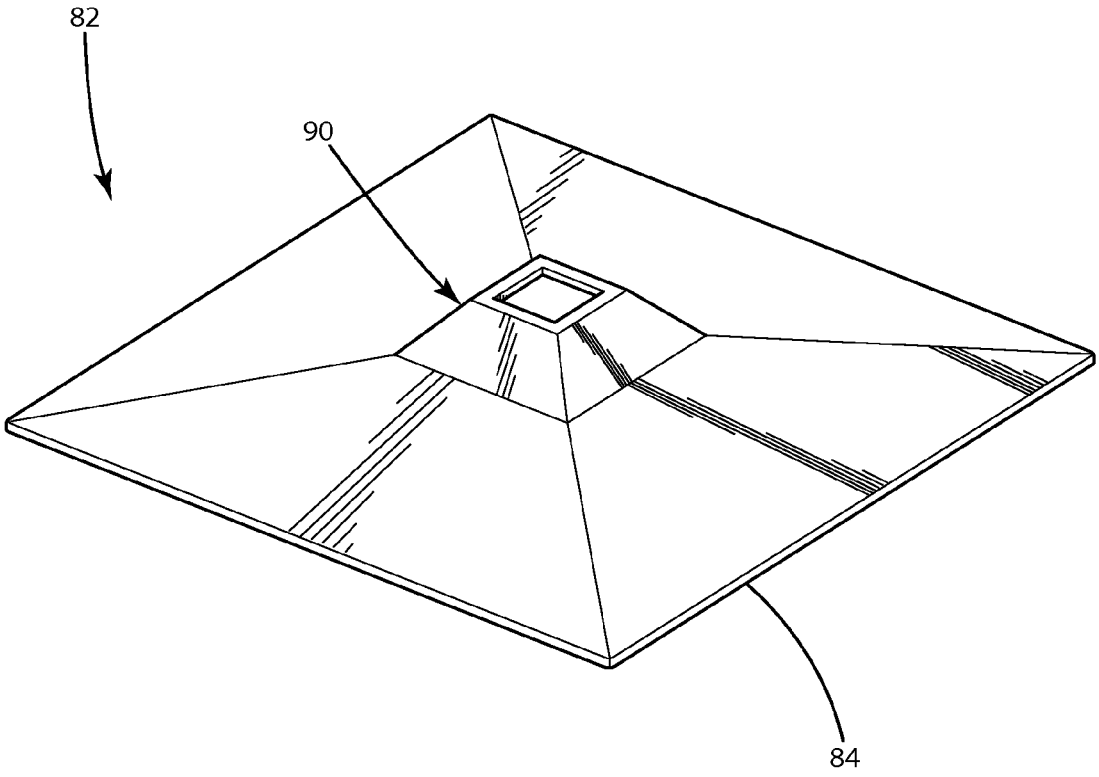
FIG. 6 is a perspective view of a shim member utilized for supporting the paver assembly.

In order to compensate for unlevel roof structures, a shim system 80 (FIG. 4) is provided. Each shim 82 (FIG. 6) is provided a square-shape body portion 84 having a bottom surface 86 adapted to abut the roof structure 14, and a top surface 88 adapted to abut a portion of the bottom wall 22 of the substrate member 18. A trapezoidally-shaped engagement member 90 extends upwardly from the body portion 84 and is received into a corresponding trapezoidally-shaped recess 92 extending into the bottom wall 22 of the substrate member 18. The corresponding trapezoidal-shape of both the engagement member 90 and the recess 92 cooperate to properly orient the shim member 82 with respect to the paver assembly 10, and also prevents the shim member 82 from shifting with respect to the paver assembly 10 subsequent to assembly. The shim member 82 is preferably constructed of a recycled polypropylene material, however, other material suitable for such use may be utilized.

The paver assembly described herein provides provide a durable paving assembly adapted for use with modular vegetated roof systems, that include an uncomplicated design which may be assembled without tools by even unskilled personnel. The present inventive paver assembly is efficient in use, economical to manufacture, capable of a long-operating life, and is particularly well adapted for the proposed use.

In the foregoing description, it will be readily appreciated by those skilled in the art that modifications may be made to the invention without departing from the concepts herein. Such modifications are to be considered as included in the following claims, unless these claims by their language expressly state otherwise.

The invention claimed is:

1. A paver assembly, comprising:

a substrate member having a bottom wall adapted to support the paver assembly above a roof surface, a plurality of sidewalls extending upwardly from the bottom wall, and at least one engagement member extending above the bottom wall, and, wherein the at least one engagement member is open hook-shaped; and an over-molded paver member having a bottom surface, a plurality of side surfaces, and a top surface adapted to support a person thereon, wherein the bottom surface is molded about the at least one engagement member, thereby securing the paver member to the substrate member.

2. The paver assembly of claim 1, wherein the paver member includes a rounded edge extended between the plurality of side surfaces and the top surface.

3. A paver assembly, comprising:

a substrate member having a bottom wall adapted to support the paver assembly above a roof surface, a plurality of sidewalls extending upwardly from the bottom wall to a first height, and at least one engagement member extending above the bottom wall, wherein the substrate member further includes at least one intermediate wall extending between a select two of the plurality of sidewalls to a second vertical height that is substantially equal to the first height, and wherein the at least one engagement member extends upward from at least a select one of the plurality of sidewalls and the at least one intermediate wall; and an over-molded paver member having a bottom surface, a plurality of side surfaces, and a top surface adapted to support a person thereon, wherein the bottom surface is molded about the at least one engagement member, thereby securing the paver member to the substrate member.

4. The paver assembly of claim 3, wherein the at least one engagement member includes a first outer surface, the wall from which the at least one engagement member extends upwardly from includes a second outer surface, and wherein the first and second outer surfaces are vertically aligned.

5. A paver assembly, comprising:

a substrate member having a bottom wall adapted to support the paver assembly above a roof surface, a plurality of sidewalls extending upwardly from the bottom wall, and at least one engagement member extending above the bottom wall; and an over-molded paver member having a bottom surface, a plurality of side surfaces, and a top surface adapted to support a person thereon, wherein the bottom surface is molded about the at least one engagement member, thereby securing the paver member to the substrate member, and wherein the paver member includes at least one irregularity extending outwardly from the plurality of side surfaces, and wherein the at least one irregularity is adapted to abut at least one irregularity of an abutting paver member.

6. A paver assembly, comprising:

a substrate member having a bottom wall adapted to support the paver assembly above a roof surface, a plurality of sidewalls extending upwardly from the bottom wall, and at least one engagement member extending above the bottom wall;

an over-molded paver member having a bottom surface, a plurality of side surfaces, and a top surface adapted to support a person thereon, wherein the bottom surface is molded about the at least one engagement member, thereby securing the paver member to the substrate member; and further including at least one shim member adapted to abut the bottom wall of the substrate member and support an area of the bottom wall less than the total area of the bottom wall.

7. The paver assembly of claim 6, wherein the at least one shim member includes a first portion of an engagement assembly, and wherein the bottom wall of the substrate member includes a second portion of the engagement assembly that engages the first portion of the engagement assembly, thereby aligning the at least one shim member with the substrate member.

8. The paver assembly of claim 7, wherein the first and second portions of the engagement assembly each have mating, trapezoidal-shaped cross-sectional configurations.

9. A paver assembly, comprising:

a substrate member having a bottom wall adapted to support the paver assembly above a roof surface, a plurality of sidewalls extending upwardly from the bottom wall, and at least one engagement member extending above the bottom wall;

a paver member coupled with the substrate member and having a bottom surface, a plurality of side surfaces, and a top surface adapted to support a person thereon; and at least one shim member that includes a first portion of an engagement assembly, wherein the bottom wall of the substrate member includes a second portion of the engagement assembly that engages the first portion of the engagement assembly, thereby aligning the at least one shim member with the substrate member.

10. The paver assembly of claim 9, wherein the first and second portions of the engagement assembly each have mating, trapezoidal-shaped cross-sectional configurations.

11. A method of forming a paver assembly, comprising:

providing a mold;

forming a paver member by placing a curable material into the mold, the paver member including a bottom surface, a plurality of side surfaces, and a top surface adapted to support a person thereon;

providing a substrate member having a bottom wall adapted to support the paver assembly above a roof surface, a plurality of sidewalls extending upwardly from the bottom wall, and at least one engagement member extending above the bottom wall;

pressing the at least one engagement member into the bottom surface of the paver member;

curing the curable material; and removing the paver assembly from the mold.

12. The method of claim 11, wherein providing the substrate member includes providing the at least one engagement member as hook-shaped.

13. The method of claim 11, wherein the step of forming the paver member includes forming the paver member to include a rounded edge extended between the plurality of side surfaces and the top surface.

14. The method of claim 11, wherein the step of forming the paver member includes forming the paver member to include at least one irregularity extending outwardly from the plurality of side surfaces, and wherein the at least one irregularity is adapted to abut at least one irregularity of an abutting paver member.

* * * * *